United States Patent [19]

Guler et al.

[11] Patent Number: 4,688,325

[45] Date of Patent: Aug. 25, 1987

[54] TECHNIQUE FOR FABRICATING OFFSET, SHAPED ANTENNA REFLECTORS

[75] Inventors: Michael G. Guler; Sharadchandra D. Patel, both of Melbourne; James K. Conn, Indialantic; Marcus L. Foster, Palm Bay, all of Fla.

[73] Assignee: Harris Corporation, Melbourne, Fla.

[21] Appl. No.: 676,924

[22] Filed: Nov. 30, 1984

[51] Int. Cl.[4] ..... H01P 11/00

[52] U.S. Cl. ..... 29/600; 72/379

[58] Field of Search ..... 29/600; 343/840, 912, 343/781 CA; 72/7, 295, 296, 379

[56] References Cited

U.S. PATENT DOCUMENTS

| | | | |
|---|---|---|---|
| 3,344,631 | 10/1967 | Suliteanu et al. | 72/7 |
| 3,490,405 | 1/1970 | Reader et al. | 72/379 |
| 3,696,435 | 10/1972 | Zucker | 343/840 X |
| 3,762,207 | 10/1973 | Weiser | 343/840 X |
| 4,021,817 | 5/1977 | Shibano et al. | 343/912 |
| 4,191,604 | 3/1980 | MacTurk | 343/912 X |
| 4,236,399 | 12/1980 | Williams et al. | 72/295 |
| 4,352,108 | 9/1982 | Milne | 343/840 X |
| 4,413,500 | 11/1983 | Myer | 72/379 X |

FOREIGN PATENT DOCUMENTS

| | | | |
|---|---|---|---|
| 2850492 | 5/1979 | Fed. Rep. of Germany | 343/840 |
| 75306 | 6/1980 | Japan | 343/840 |

OTHER PUBLICATIONS

"Double Parabolic Cylinder Pencil-Beam Antenna", Spencer et al.

"The Open Cassearain Antenna: Part I, Electromagnetic Design and Analysis", Cook et al.

*Primary Examiner*—Howard N. Goldberg

*Assistant Examiner*—Joseph M. Gorski

*Attorney, Agent, or Firm*—Antonelli, Terry & Wands

[57] ABSTRACT

An antenna fabrication scheme for shaped reflectors analyzes the geometry of the shaped reflector to be fabricated. On the basis of this analysis, a surface of revolution which closely approximates the shaped reflector is defined. The axis of revolution of the generated surface can then be employed by a single reflector shaping tool to describe the surface of revolution a portion of which approximates that of the desired shaped reflector. The shaped reflector is then effectively removed from the described surface by defining the perimeter of the shaped reflector on the surface of revolution.

11 Claims, 19 Drawing Figures

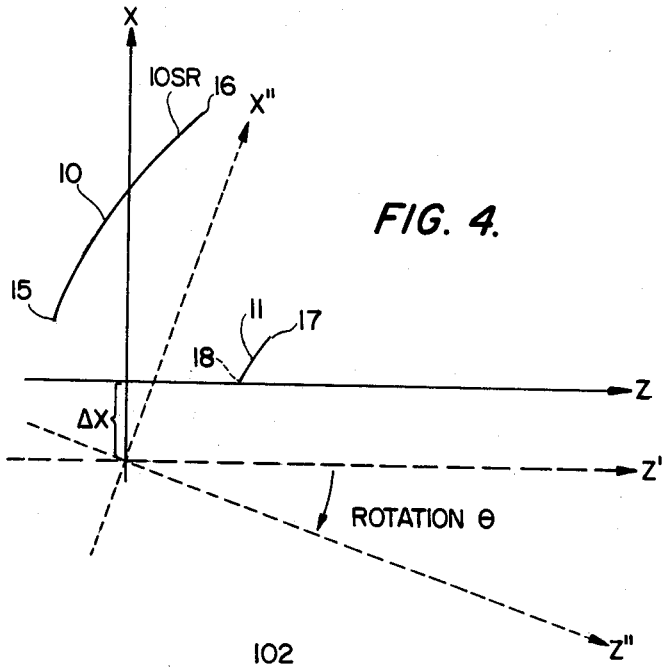
FIG. 4.
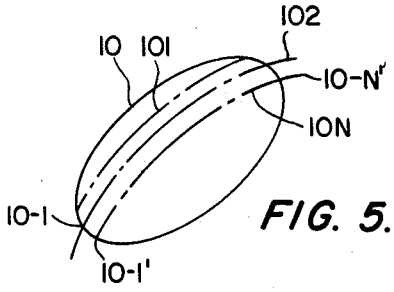
FIG. 5.
FIG. 6.
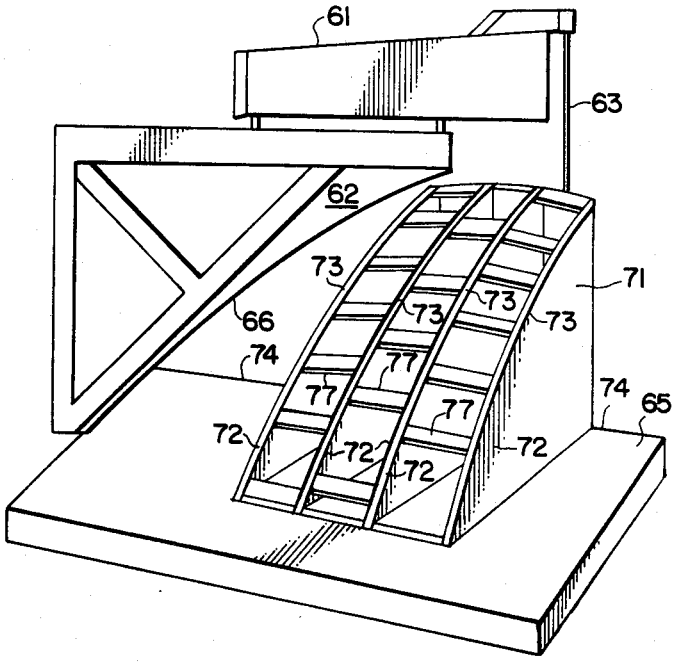

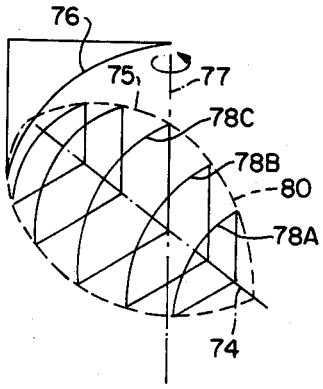
FIG. 7.
FIG. 8.
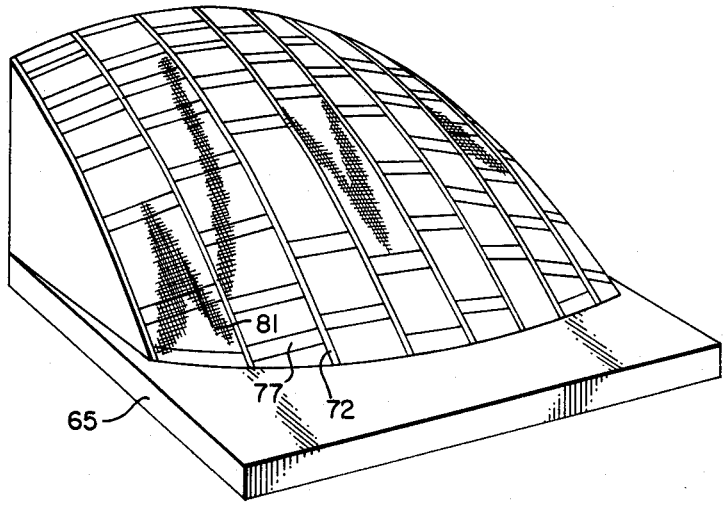
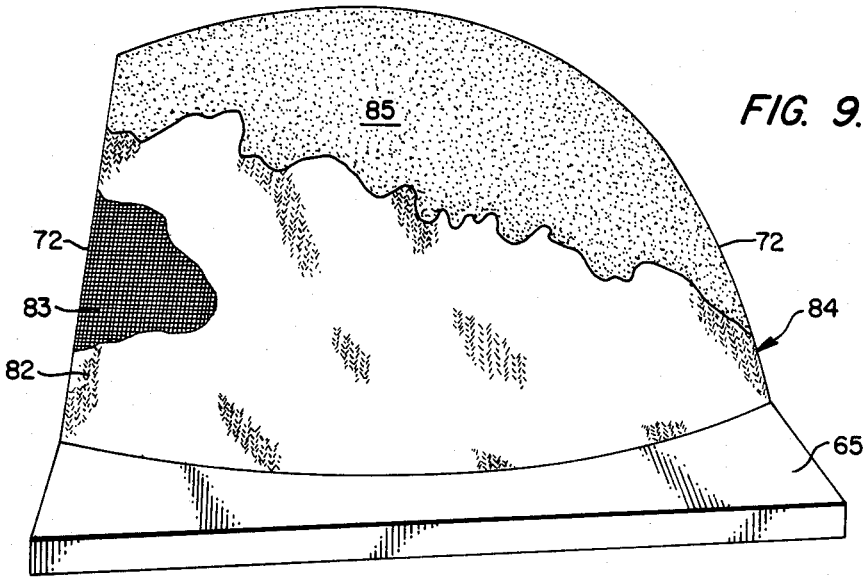
FIG. 9.

TECHNIQUE FOR FABRICATING OFFSET, SHAPED ANTENNA REFLECTORS

FIELD OF THE INVENTION

The present invention relates to the fabrication of antenna reflector elements, and is particularly directed to a scheme for manufacturing offset, unsymmetrically-shaped antenna reflectors using a single reflector-shaping tool, rather than requiring unique tools for multiple reflector panels of which the antenna is constructed.

BACKGROUND OF THE INVENTION

The design of an antenna for a particular communication system typically involves a consideration of the sought after performance of the system and the tooling costs in manufacturing the reflector elements of which the antenna will be configured. In items of performance, shaped offset (or clear aperture) geometry reflectors enjoy little or no blockage, high illumination efficiency with low spillover, and good control of sidelobes. However, different (unique) tooling is required for each panel, making the overall manufacturing process extremely costly.

The use of centerfed shaped reflectors and unshaped offset reflector, on the other hand, can reduce tooling requirements by a factor of four or five. However, the savings in cost of manufacture suffers a penalty in antenna performance, as efficiency will drop due to either high blockage or greater spillover.

SUMMARY OF THE INVENTION

In accordance with the present invention, there is provided an antenna fabrication scheme through which high performance antenna systems, i.e. those using offset, shaped reflectors, may be produced economically, without the need for unique tooling for the manufacture of differently shaped unsymmetric reflector panels. For this purpose, the present invention employs a scheme that analyzes the geometry of the shaped reflector to be fabricated. On the basis of this analysis, a surface of revolution which closely approximates (provides a "best fit" surface for) the shaped reflector is defined. The axis of revolution of the generated surface can then be employed by a single reflector shaping tool to describe the surface of revolution a portion of which approximates that of the desired shaped reflector. The shape reflector is then effectively removed from the described surface by defining the perimeter of the shaped reflector on the surface of revolution.

In the course of analyzing the geometry of the shaped reflector in order to define the surface of revolution to be used in the tooling process, different axes of revolution for prescribed geometrical surfaces are iteratively employed. For each selected axis of symmetry, the resulting surface of revolution is compared with the desired surface and a weighted error is calculated. The weighting function used is based upon the area represented by each point on the surface and the illumination function at that point. The axis which produces the least error is selected as the axis of revolution to be used for fabrication. The axis is specified relative to a line through the feed phase center of the antenna parallel to the boresight axis.

BRIEF DESCRIPTION OF THE DRAWINGS

FIG. 4 shows the antenna reflector arrangement of FIG. 1 with an inclination of the X and Z axes subsequent to the translation shown in FIG. 3.

FIG. 5 is a pictorial view of the main reflector 10 of FIG. 1, and depicting adjacent lines of curvature 101 . . . 10N;

FIG. 6–18 show respective stages of the forming of a shaped reflector and its assembly to an attendant support structure.

DETAILED DESCRIPTION

For purposes of facilitating an understanding of the present invention, the description to follow will explain the application of the principles of the invention to the fabrication of a shaped, offset, parabola-hyperbola Cassegrain reflector configuration. It should be understood, however, that this particular type of antenna structure is employed only as an example and is not intended to be limitative of the invention. Accordingly, it is to be appreciated that the technique described herein has equal application to other shaped reflector configurations and may be similarly employed in their fabrication.

Figure 1:
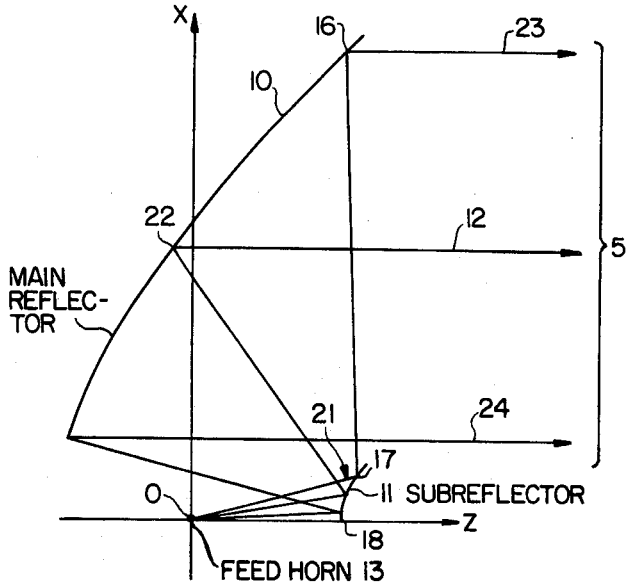
FIG. 1 is a sectional side view of a shaped offset parabola-hyperbola Cassegrain antenna reflector arrangement.
Figure 2:
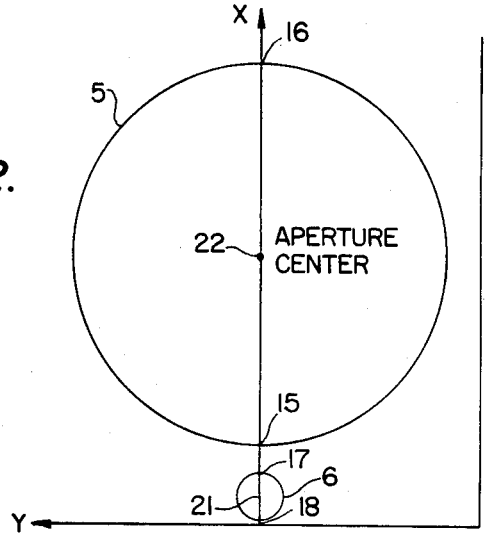
FIG. 2 is a view of the shaped offset parabola-hyperbola Cassegrain antenna reflector arrangement of FIG. 1 taken along a line parallel to axis (Z)

Referring now to FIGS. 1 and 2, superimposed upon a rectangular coordinate system, there are shown representative side sectional (along axis Y) and front (along axis Z) views of a shaped, offset, parabola-hyperbola Cassegrain reflector arrangement having shaped-parabolic main reflector 10 and a hyperbolic subreflector 11. In the FIGS., the origin of the rectangular coordinate system coincides with the emission point of an antenna feedhorn 13, and the Z axis is parallel to the axis of the aperture 5 of main reflector 10. By shaped is meant that the surface geometry of one or both of the reflectors 10 and 11 has been changed from a true parabola (main reflector 10), hyperbola (subreflector 11) surface of revolution that would be describable about axis Z. By offset is meant that the subreflector 11 and the supporting structure (as well as the feedhorn 13) are positioned outside the aperture 5 of main reflector 10, so that none of the collimated energy from main reflector 10 is scattered by the feed components or their supporting structure.

It should be observed that FIG. 1 shows the curvature of each of main reflector 10 and subreflector 11 in the X-Z plane; the emission axis of feedhorn 13 lies in the X-Z plane and the antenna surface enjoys mirror symmetry relative to the X-Z plane.

As mentioned above, the point of emission of feedhorn 13 is located at the intersection O of the X and Z axes. The side-sectional beam outline from feedhorn 13 is defined by ray 23 which extends from emission point O to upper edge boundary 17 of subreflector 11, and reflects off upper edge boundary 16 of the shaped-parabolic main reflector 10. The aperture center line 12 extends from emission point O to the point 21 of subreflector 11, and reflects off the point 22 of the shaped-parabolic main reflector 10. The aperture center line 12 extends from emission point O to the center 21 of aperture 6 (FIG. 2) of subreflector 11 and reflects off center 22 of main reflector 10 to define the center of circular aperture 5 of main reflector 10. The other extremity (in the X-Z plane) of the side-sectional beam outline is defined by beam ray 24 which extends from emission point O to lower edge boundary 18 of subreflector 11 and reflects off of lower edge boundary 15 of main reflector 10. The effective geometrical (parabolic) vertex of main reflector 10 intersects the Z axis at 14.

As described above and as shown in FIGS. 1 and 2, the antenna configuration of the present example is symmetric with respect to the X-Z plane. Because of this X-Z symmetry, the "best fit" axis of symmetry through which a surface of revolution approximating the shaped reflector surface of interest (e.g., shaped parabolic main reflector 10) must lie in the X-Z plane and thereby pass through the X-axis.

Figure 3:
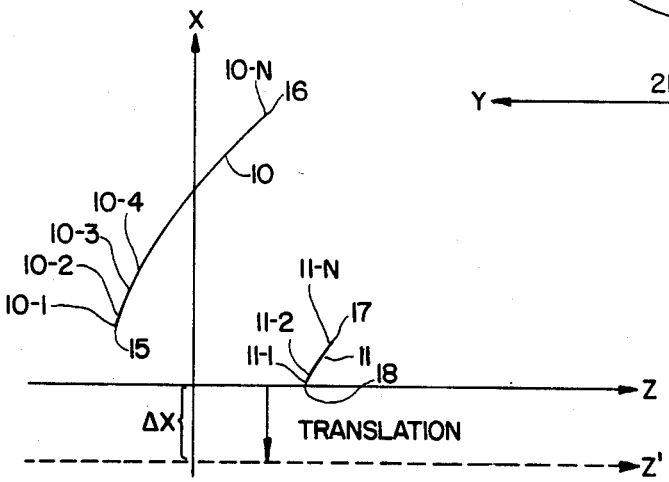
FIG. 3 shows the antenna reflector arrangement of FIG. 1, with a translation of the Z axis in the negative X direction.

FIGS. 3 and 4 show, respectively, translations and inclinations of the X and Z axes that are carried out in accordance with the principles of the present invention in the process of analyzing the geometry of the shaped reflector of interest to determine what axis will produce a surface of revolution that best approximates the surface of the shaped antenna reflector. In FIG. 3, the surfaces of main reflector 10, as intersected by the X-Z plane, may be considered to be comprised of a series of lines connecting a plurality of points 10-1, 10-2, 10-3 . . . 10-N, point 10-1 coinciding with lower edge boundary 15 and point 10-N coinciding with upper edge boundary 16. For additional planes adjacent to the X-Z plane, and intersecting the surface of reflector 10, there may defined similar sets of points along a plurality of lines, so that the surface of reflector 10 may be considered to be defined by a plurality of connected points 10-1' . . . 10-N', etc. lying along adjacent lines of curvature 101, 102, . . . , 10N that are effectively parallel with on another.

In accordance with the present invention, because of the mirror symmetry of the surface of the shaped reflector relative to the X-Z plane, the axis of revolution to be eventually defined must lie in the X-Z plane and intersect both the X and Z axes, as noted previously. Using the procedure described below, a plurality of points on the surface of the shaped reflector (e.g., reflector 10) which lie in the XZ plane are examined to derive a polynomial function which, in the XZ plane, effectively fits or matches the curvature of the shaped reflector surface. Through an iterative procedure, the approximate curve of the polynomial function is then rotated about an axis lying in the XZ plane which is successively translated (in the X direction) and inclined (relative to the Z axis) to generate a series of surfaces of revolution. Differences in separation (in the Z direction) of points on each generated surface of revolution with corresponding points on the desired shaped surface produce a weighted error characteristic for that surface. The axis of revolution which results in the lowest error characteristic is then selected as the axis about which a reflector shaping tool (e.g., employing a shaping template defined by the polynomial function) may be rotated to produce reflector panels the surface characteristics of which effectively match or "best fit" the desired shaped surface.

Two methods for generating the approximate surface of revolution (e.g., surface 10SR of FIG. 4) may be used. The first method finds the least squares best fit curve for points P of the rectangular coordinate form (X, O, Z) and sweeps (rotates) the best fit curve about an axis of revolution to calculate errors at other points on the shaped surface. The second method transforms the curve to a cylindrical coordinate system (r, $\theta$, Z) and then finds the least squares best fit curve for points P in the cylindrical coordinate system.

More particularly, each method defines a surface of revolution about axis Z'' for respective values of offset distanc $\Delta X$ and angle of inclination $\theta$ by a least squares curve fitting or matching process. This process finds the coefficients of $a_i$ of a polynomial equation of the form $$Z=a_0+a_1r+a_2r^2+\ldots a_nr^n \quad (1)$$

where Z is the predicted Z coordinate value of a respective point P in the shaped surface of interest (e.g., main reflector 10), and r is the distance from the axis of revolution Z'' to point P. Those coefficients are chosen which minimize the error term E, defined as:

$$E = \sum_{i=1}^{N} (Z_i - Z_{ei})^2 \quad (2)$$

where $Z_i$=the actual Z axis coordinate of point P, $Z_{ei}$=Z coordinate on the surface of revolution swept about axis Z'', and N=the number of points P examined.

Using a computer program which is iterated over successively prescribed values of offset $\Delta X$ and inclination angle $\theta$ of proposed axis of revolution, the above equations (1) and (2) are executed to find a least squares best fit for respective points P in the XZ plane (i.e., having coordinates of the form (X, O, Z) or (r, $\theta$, Z) depending upon the coordinate system chosen) and the resulting curve (e.g., 10SR) is then rotated about the selected axis Z'' to calculate errors at other points on the surface.

The iterative procedure comprises defining the surface of revolution at each of the $\Delta X$'s or $\Delta\theta$'s located at the beginning, mid-point, and end of the interval of $\theta$ or X of interest. For each surface, the above error E is calculated and the point yielding the smallest error is chosen as a reference location. Then, a new interval half as long as the previous interval and centered about this "lowest error" reference location is defined and the process is successively repeated to converge at prescribed tolerance "best fit" reference location. This procedure is employed for both variations $\Delta X$ in X axis offset and variations $\theta$ in inclination offset with respect to the reference axis Z, to determine a "best fit" surface of revolution which minimizes the error E in the Z coordinate of the above equation (1). Namely, that surface of revolution for which a minimum RMS error is produced is selected as the surface to be employed for approximating the shaped reflector.

As described above, the tooling for the shaped surface employs a best fit axis of rotation Z'' about which a reflector shaping element, controlled by a template containing the polynomial function, may be swept to produce the approximated "best fit" reflector panel. Depending upon the type of tooling employed, the actual manufacturing steps used in carrying out the rotational shaping of the reflector of interest will vary.

To illustrate the application of the present invention to a present day antenna manufacturing and assembly process, attention is directed to FIGS. 6–18, which show the configuration of a shaped main reflector, such as shaped parabolic main reflector 10 in FIG. 1, at respective stages of its formation and assembly to an attendant support structure. Typically, as shown in FIG. 6, the shaping or curvature defining assembly comprises a template rotation unit 61 that sweeps a template 62 about an axis of revolution 63 (here corresponding to the best fit Z″ axis) over a framework support bed 65. Template 62 has a curved edge 66 that corresponds to the polynomial function, generated in the manner described previously, that will produce the best fit surface of revolution for the shaped reflector antenna desired, when rotated about Z″ axis 63.

On framework support bed 65 a plurality of parallel-spaced plywood framing panels 72 are interconnected by spacer spars 77 to form a base mold structure 71 on which the shaped surface of interest is to be formed. Each of panels 72 has a contour edge 73 that corresponds to the intersection of a planar slice through the shaped surface of interest that is perpendicular to an edge line 74 of frame bed 65. This is shown graphically in FIG. 7 which illustrates a surface of revolution 75, formed by sweeping polynomial defined curve 76 about an axis 77. Through that surface 75 there may be defined the intersection of a plurality of spaced apart planes 78A, 78B, 73C . . . , that are parallel to one another and perpendicular to a base line 74. Since the polynomial function for curve 76 is known, the coordinators of any plane passing through surface 75 are readily deriveable by analytic geometry. Again, as in the case for deriving the coefficients for the polynomial function for curve 76, these coordinates are computer-calculated to effectively produce a set of patterns for each of planes 78A, 78B, 78C . . . from which the outline contours for plywood panels 72 may be cut. Of course, the base line coordinates are correspondingly laid out on the floor of framework support bed 65 and the spar-connected panels are assembled to form an overall molding framework.

FIG. 8 shows the completed multi-panel molding framework structure 71 over which a first layer of wire mesh 81 is formed. Next, as shown in FIG. 9, a cloth (e.g. burlap) layer 82 is stretched across wire mesh layer 81 followed by a second wire mesh layer 83, to form a contour base mesh laminate 84 that effectively corresponds to the shaped surface defined by the panels 72 of the framework 71. This wire/cloth mesh laminate 84 serves as a forming base for a layer of plaster 85 that is built up on the mesh to a thickness sufficient to provide a smooth surface when screeded by the rotation of template 62.

Figure 10:
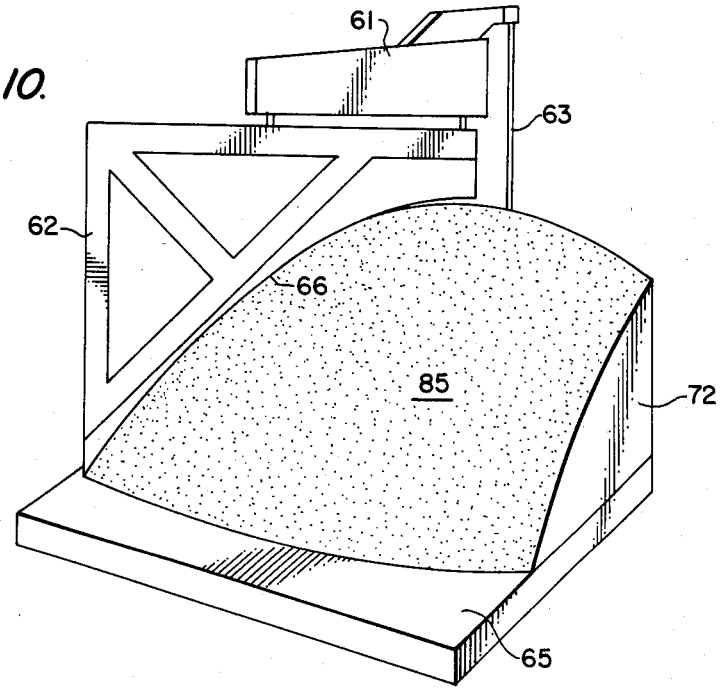
Figure 11:
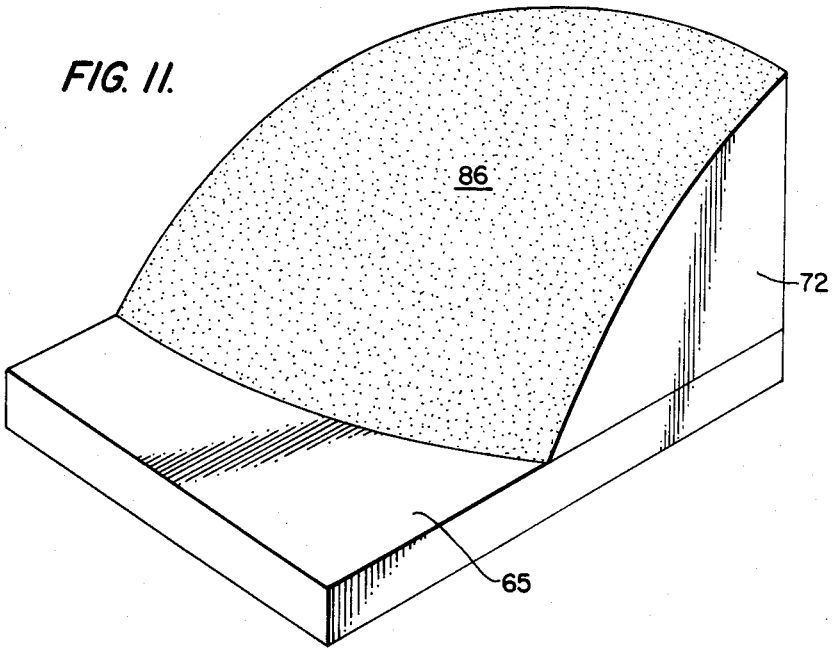

The screeding of the plaster is shown in FIG. 10 which illustrates the rotation of template 62 of template support/rotation unit 61 across the plaster build-up on the antenna mold. As edge 66 of screeding template 62 travels over the plaster 85 it effectively or contours the plaster to produce a smooth mold surface 86 (FIG. 11) on which the antenna reflector panel is to be formed.

Figure 12:
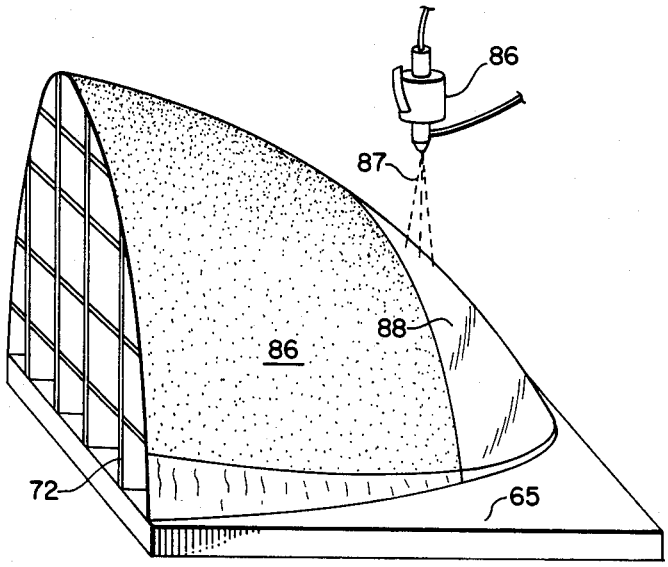
Figure 13:
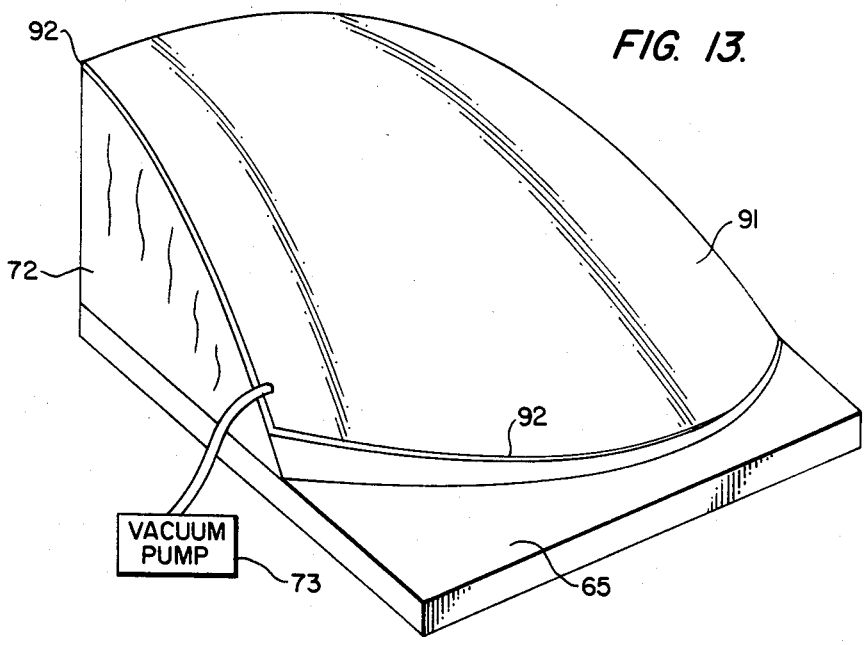

Next, as shown in FIG. 12, a reflector layer 88 is formed on plaster surface 85 by the use of flame spraying tool 87 which flame-sprays a metallic (e.g. aluminum) mist 86 onto the plaster 86. Prior to this spraying operation, the surface of the mold is coated with a separation film that permits subsequent removal of the metallic reflector layer 88. The flame-sprayed metallic layer 88 is then cured under vacuum by covering the sprayed mold surface with a plastic sheet 91, sealing the edges 92 of the sheet and coupling a vacuum connection 73 to the sheet, as shown in FIG. 13.

Figure 14:
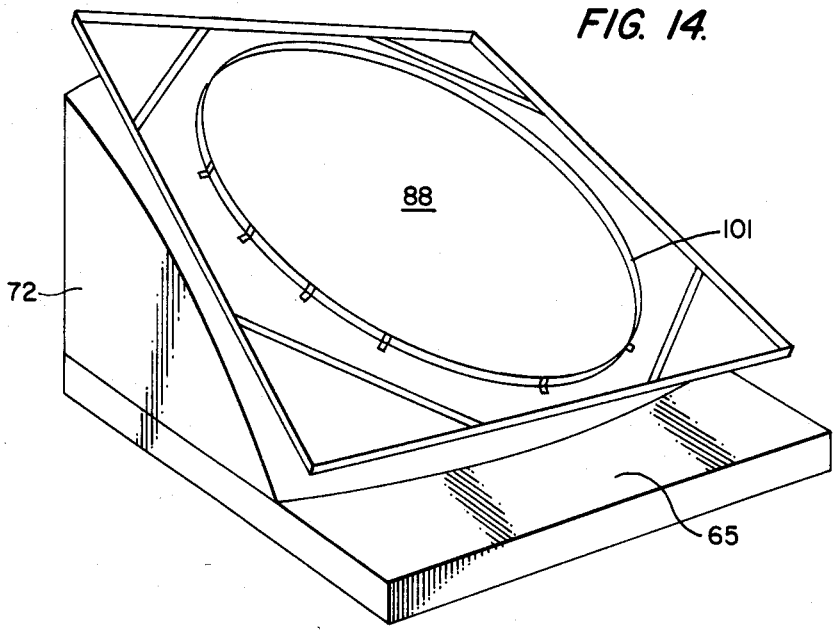
Figure 15:
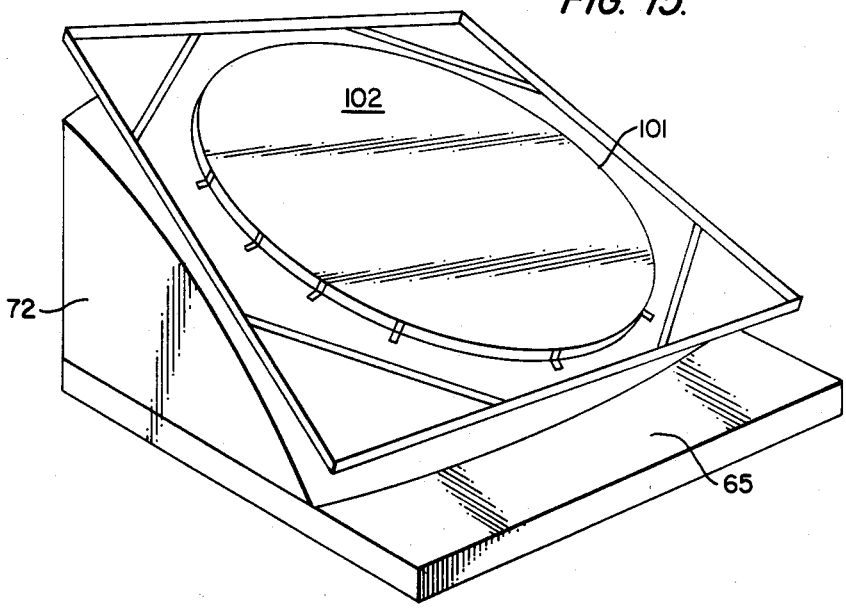
Figure 16:
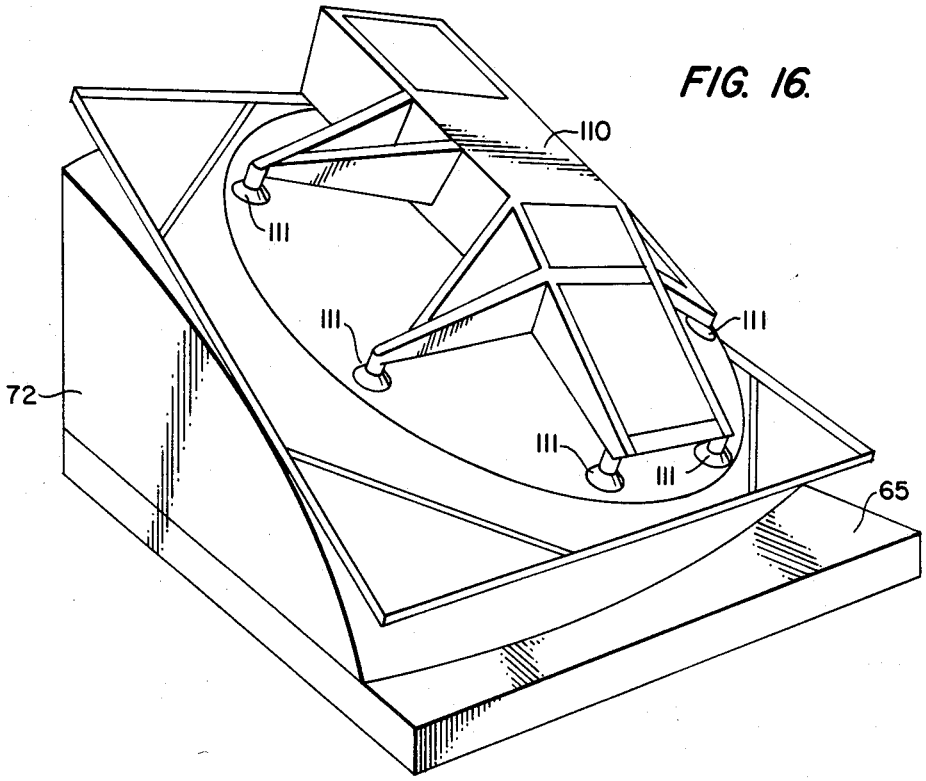
Figure 17:
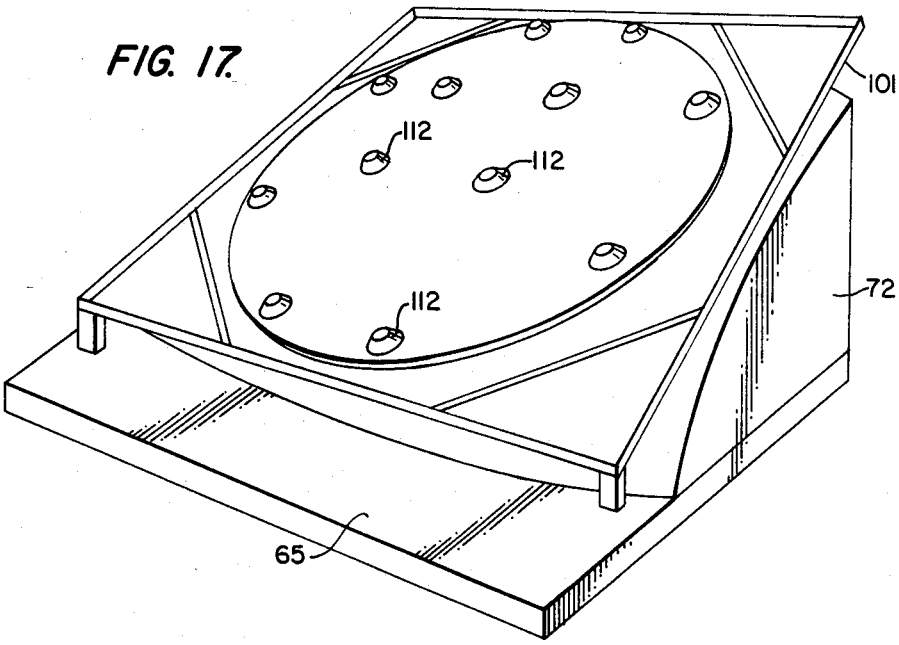
Figure 18:
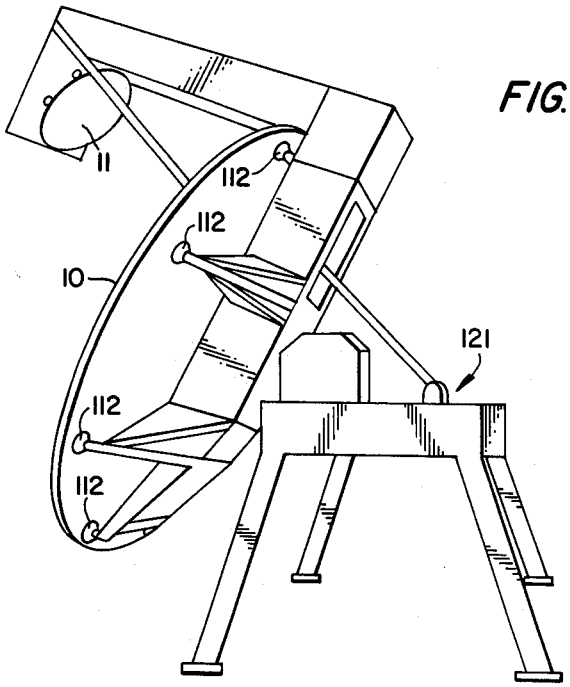

After the reflector layer 88 has cured, a reflector edge locator tool or ring assembly 101 is placed over the curved metallic surface, as shown in FIG. 14, and a synthetic (e.g. plasticized/epoxy) support material 102 that will form the rear face of the reflector is coated over the reflector layer 88 as circumscribed by ring assembly 101 (FIG. 15). Next, as shown in FIG. 16, a reflector panel support structure 110 is placed over the rear face of the reflector panel, and individual reflector support points 111 are located. At each support point on the rear face of the reflector panel, respective support elements 112 are then potted and cured, as shown in FIG. 17. The support ring assembly 101 is then removed and the shaped reflector panel is affixed to the support structure 110 for mounting on a support pedestal 121 for the shaped offset antenna structure, as shown in FIG. 18.

Figure 19:
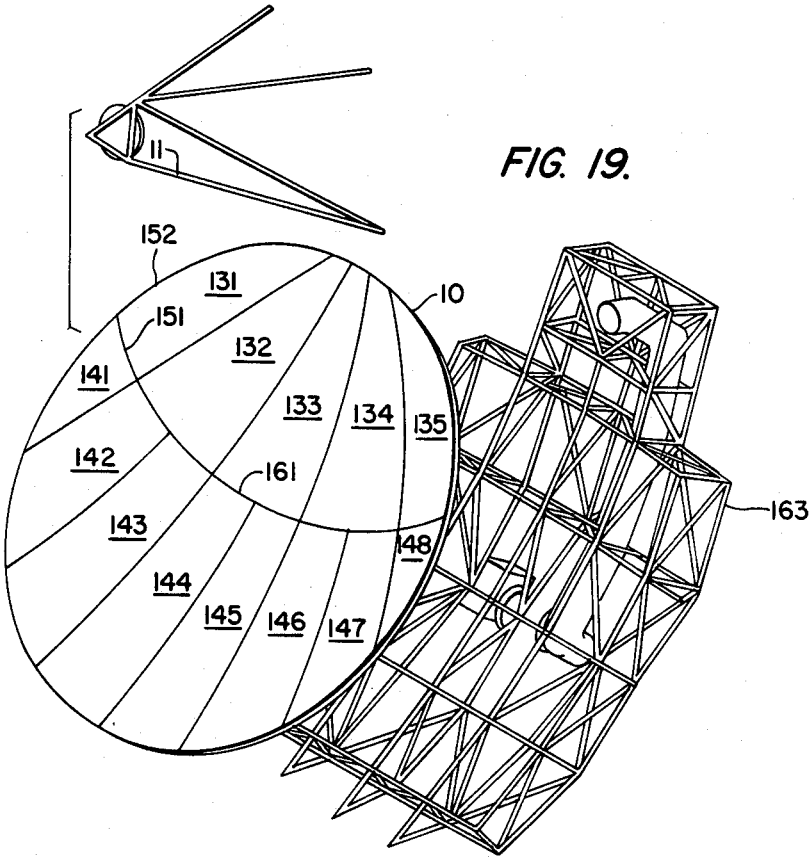
FIG. 19 is an exploded assembly illustration of a dual offset shaped parabola-hyperbola Cassegrain antenna containing a multi-panelled main reflector.

Rather than form a reflector panel as a molded single piece element, the shaped surface may comprise a plurality of reflector panel sections to be edged-joined to one another to yield the overall shaped reflector configuration. An example of such an arrangement is shown in FIG. 19 which illustrates a dual offset parabola-hyperbola Cassagrain shaped reflector configuration in which shaped main reflector 10 is comprised of a first group of five successively contiguous inner panel sections 131, 132, 133, 134, 135 and a second group of eight successively contiguous outer panel sections 141, 142, 143, 144, 145, 146, 147, 148, with the second group of panel sections 141-148 being contiguous with the first group of panel sections 131-135 at joining edge 151.

Line 161 is coincident with the joined edges of panels 144 and 145, bisects panel 133, and effectively corresponds to the line curvature 10SR lying in the XZ plane described above with reference to FIGS. 1–4, so that panels 141–144 are respective mirror images of panels 148–145, and panels 131, 132 are respective mirror images for panels 135, 134, as are the two halves 133A, 133B of panel 133.

As in the embodiment of FIGS. 6–18, the panels may be shaped by sweeping a template, having an outline shape corresponding to curvature line 165 (10SR), about an axis of revolution established in accordance with the above-described procedure, over sections of aluminum skin that are to be employed for panel sections 131–135 and 141–148. The sections are then cut along perimeter lines corresponding to the edges to be joined together and the outer perimeter edge 152 of the overall reflector panel.

Each panel may employ aluminum formed channel side rails joined by spaced apart transveral stiffeners (not shown). These side rails and stiffeners are joined together to form a truss-like structure using the tooling template to the outline curvature of the rails to which the aluminum strips are affixed. The respective sections 131–135 and 141–148 that have been shaped using the surface of revolution tooling procedure of the present invention are then bonded to a panel backup structure 163.

As an exemplary illustration of the application of the technique of the present invention, for the shaped-hyperbolic subreflector - shaped parabolic main reflector configuration described above, operating at a frequency of 20 GHz, mechanical parameters criteria for the respective reflectors 10 and 11 were established as follows:

(1) Aperture Radius—48"
(2) Maximum Diameter of Feedhorn—5"
(3) Feed Taper—20 dB
(4) Minimum diameter of subreflector 11
(5) Minimum Surface Area of Main Reflector 10
(6) Substantially no Blockage For specified parameters (2) and (3), the feed angle must be greater than or equal to 20°. The feed angle and focal length then determine input parameter S (distance of subreflector 11 below focal point) and the location of the vertex of the main reflector 10. In this example, the focal length was selected as 58.5" to maintain a low surface area reflector and the aperture center location 22 was set 60" from the vertex 14 to eliminate blockage. Based on these decided upon values the mechanical parameters may be defined as follows:

1. Aperture Radius: RA=48"
2. Focal Length: F=58.5"
3. Main Reflector Vertex Location: XV=0", ZV= −30"
4. Aperture Center Location: XA=60", YA=0"
5. Feed Taper at Subreflector Edge: 20 dB
6. Distance of Subreflector Below Focal Point: S=5"

With these parameters established, then, in carrying out the surface of revolution approximation technique according to the present invention, the polynomial function produces a "best fit" axis Z" for main reflector 10 such that a reflector swept about the unchanged axis Z would have an average phase error of 90° and a maximum phase error of 495°. A reflector swept about the "best fit" axis of symmetry Z" has an average phase error of only 5.3° and a maximum phase error of 89°. The large error points are located near the edge of the reflector, so they do not cause a major degradation in the far field pattern. The maximum phase error in the dish interior is 15°. An aperture phase error efficiency has been calculated across the worst aperture axis. This efficiency figure is 97%. The RF characteristics for the 20 GHz Cassegrain reflector arrangement described above have been determined to provide a maximum gain for the 48-inch radius aperture at 54.16 dB at 20 GHz.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

What is claimed:

1. A method of fabricating an antenna reflector having a surface configuration which is unsymmetric with respect to any axis, comprising the steps of:

(a) analyzing the surface configuration of a reflector to be fabricated and, on the basis of the analysis, establishing a geometrical surface of revolution describable about a prescribed axis, at least a portion of said geometrical surface of revolution containing a shape approximating that of the surface configuration of said reflector to be fabricated; and (b) engaging a reflector tooling device with material of which the antenna reflector is to be fabricated, and sweeping said reflector tooling device about said prescribed axis about which said geometrical surface of revolution is describable while maintaining engagement of the tooling device with the material, thereby shaping the material into a reflector that conforms with said geometrical surface of revolution and effectively contains said unsymmetric surface configuration.

2. A method according to claim 1, wherein step (a) comprises establishing said geometrical surface of revolution about an axis, corresponding to said prescribed axis, which is definable by a translation and an inclination of a preselected axis.

3. A method according to claim 2, wherein said geometrical surface of revolution is established by rotating a prescribed curve about iteratively defined axes of revolution corresponding to successive translations and inclinations of said preselected axis.

4. A method according to claim 3, wherein step (a) includes the step of measuring variations in the shape of asid geometrical surface of revolution for successive rotations of said prescribed curve about said translated and inclined preselected axis and, therefrom, establishing, as said prescribed axis, that axis of revolution which produces a surface of revolution having the smallest prescribed error characteristic based on said measured variations.

5. A method according to claim 1, wherein the surface configuration of said antenna reflector is symmetric with respect to a plane containing said preselected axis and wherein step (a) compreses generating a curve effectively conincident with a line along which the surface configuration of said antenna reflector intersects said plane, and rotating said curve about iteratively defined axes of revolution corresponding to successive translations and inclinations of an axis relative to said preselected axis.

6. A method according to claim 5, wherein step (a) includes the step of measuring variations in the shape of said geometrical surface of revolution for successive rotations of said prescribed curve about said translated and inclined preselected axis and, therefrom, establishing, as said prescribed axis, that axis of revolution which produces a surface of revolution having the smallest prescribed error characteristic based on said measured variations.

7. A method according to claim 6, wherein said reflector has an aperture and wherein said preselected axis is parallel to the axis of the aperture of said reflector.

8. A method according to claim 5, wherein said curve is defined in the form of the polynomial expression $$Z=a_0r^0+a_1r^1+a_2r^2+a_3r^3+\ldots a_nr^n$$

where Z is the distance between coordinates along said preselected axis, relative to a preestablished axis, of a respective point on said intersection, r is the distance between an iteratively defined axis of revolution and said respective point on said intersection, and $a_0$, $a_1$, $a_2$, $a_3 \ldots a_n$ are coefficients.

9. A method according to claim 8, wherein a prescribed error characteristic E is defined in accordance with the expression $$E=\sum_{i=1}^{N}(Z_i-Z_{ei})^2$$

where $Z_i$ is the actual coordinate location along said preselected axis of a respective point $p_i$ on said antenna reflector, $Z_{ei}$ is the coordinate of a respective point on the surface of revolution corresponding to point $p_i$ on said antenna reflector, and N is the number of points examined along said intersection.

10. A method according to claim 1, wherein step (b) comprises rotating said tooling device about said prescribed axis, thereby defining the surfaces of a plurality of reflector panels and assembling said reflector panels together, thereby producing said antenna reflector.

11. A method according to claim 3, wherein step (b) comprises the step of causing said tooling device to sweep a tooling element having a shape corresponding to that of said prescribed curve about asid prescribed axis, thereby causing material of which said antenna reflector is formed to effectively conform with said geometrical surface of revolution.

* * * * *